US008062616B2

(12) United States Patent
Chapman et al.

(10) Patent No.: US 8,062,616 B2
(45) Date of Patent: Nov. 22, 2011

(54) METHOD FOR TREATING SPENT POT LINER

(75) Inventors: Chris Chapman, Fairford (GB); Hao Ly, Zurich (CH); David Deegan, Bampton (GB)

(73) Assignee: Tetronics Limited, Swindon, Wiltshire (GB)

( * ) Notice: Subject to any disclaimer, the term of this patent is extended or adjusted under 35 U.S.C. 154(b) by 0 days.

(21) Appl. No.: 12/532,948

(22) PCT Filed: Mar. 26, 2008

(86) PCT No.: PCT/GB2008/001037

§ 371 (c)(1),
(2), (4) Date: Feb. 9, 2010

(87) PCT Pub. No.: WO2008/117044

PCT Pub. Date: Oct. 2, 2008

(65) Prior Publication Data

US 2010/0137671 A1 Jun. 3, 2010

(30) Foreign Application Priority Data

Mar. 26, 2007 (GB) ..... 0705818.3

(51) Int. Cl.
*A62D 3/00* (2007.01)

(52) U.S. Cl. ..... 423/111; 75/10.46; 75/10.21; 588/311; 588/410

(58) Field of Classification Search ..... 423/111, 423/DIG. 10, DIG. 12; 75/10.46, 10.21; 588/311, 410
See application file for complete search history.

(56) References Cited

U.S. PATENT DOCUMENTS

| | | | | |
|---|---|---|---|---|
| 4,735,784 | A | 4/1988 | Davis et al. | |
| 5,164,174 | A | 11/1992 | Banker et al. | |
| 5,222,448 | A | 6/1993 | Morgenthaler et al. | |
| 5,286,274 | A | 2/1994 | Lindkvist et al. | |
| 5,364,447 | A * | 11/1994 | Philipp et al. | 75/500 |
| 5,711,018 | A | 1/1998 | Hittner et al. | |
| 6,498,282 | B1 | 12/2002 | O'Connor et al. | |

FOREIGN PATENT DOCUMENTS

| | | |
|---|---|---|
| EP | 0550136 | 7/1993 |
| WO | 9321479 | 10/1993 |
| WO | 9422604 | 10/1994 |

OTHER PUBLICATIONS

International Search Report, PCT/GB2008/001037, dated Sep. 17, 2008, 3 pages.
Written Opinion, PCT/GB2008/001037, dated Sep. 17, 2008, 6 pages.

* cited by examiner

*Primary Examiner* — Steven Bos
(74) *Attorney, Agent, or Firm* — Senniger Powers LLP

(57) ABSTRACT

The present invention relates to a method for treating spent pot liner material (SPL) containing carbon and/or an inorganic material, the method comprising: providing a plasma furnace having first and second electrodes for generating plasma and a crucible having a non-electrically conductive inner surface, heating the SPL material in the crucible in the presence of a flux material and an oxidant by passing an arc between the first and second electrodes via the SPL material to form a molten slag material and convert at least some of the carbon in the SPL material to CO and/or CO2 and/or incorporate at least some of the inorganic material into the molten slag material.

10 Claims, No Drawings

METHOD FOR TREATING SPENT POT LINER

REFERENCE TO RELATED APPLICATIONS

This application is the U.S. national stage application of International Patent Application No. PCT/GB2008/001037, filed Mar. 26, 2008, and claims the benefit of Great Britain Application No. 0705818.3, filed Mar. 26, 2007, the entire disclosures of which are incorporated herein by reference.

FIELD OF THE INVENTION

The present invention relates to the treatment of spent pot liner material using plasma. "Spent pot liner" (SPL) material is a common term in the primary aluminium producing industry. It refers to the deteriorated lining of a pot in which aluminium has been produced in an electrolysis process from its ores, as described below. Typically, 22 kg of SPL is produced per tonne of primary aluminium.

BACKGROUND

The most common method of producing primary aluminium from its ores is the so-called Hall-Heroult process. This involves dissolving aluminium ore (containing $Al_2O_3$) in molten cryolite ($Na_3AlF_6$). $AlF_3$ is also usually present in the mixture to reduce the melting point of cryolite. The mixture is electrolysed, which mobilizes the aluminium ions in a liquid phase. In the presence of carbon, $Al_2O_3$ is reduced to elemental aluminium, and the carbon is oxidised to carbon monoxide. The electrolysis of the aluminium oxide is carried out in "pots", the internal walls and bottom of which are formed from carbon blocks, which are typically joined with a conductive material. These pots form part of the cathode during the electrolysis. The carbon linings of the pot are typically surrounded externally by refractory firebricks and insulating bricks, which usually contain silica and/or alumina. Over a period of years of continual use, the carbon of the pots will absorb salts from the molten ore/cryolite mixture, resulting in their deterioration, at which point the pots needs to be replaced. When SPL is removed, it is prepared and separated into a "first cut" and a "second cut". The first cut refers to the carbonaceous material from the cathode lining, while the second cut comprises mostly refractory material. The waste or 'spent' pot liner (SPL) material typically contains one or more of carbon, silica, alumina, aluminium, sodium salts, aluminium salts, fluoride salts, cyanides and traces of heavy metals. Because of the reactive and harmful nature of these species, the SPL material needs to be handled and disposed of carefully to avoid danger to human health and to the environment. This is becoming increasingly important in view of environmental legislation being brought into force in many countries.

A number of treatments of SPL materials have been suggested in the prior art, none of which is entirely satisfactory.

There are two general approaches for the treatment of SPL waste: 1) hydrometallurgical treatment and 2) thermal treatment. Around the world there are only a few purpose built plants that treat SPL, which indicates the problems faced in producing a safe and commercially viable method of treating SPL material.

Hydrometallurgical Treatments

An example of a hydrometallurgical treatment of SPL is the Low Caustic Leaching and Liming process (LCLL Process) developed by Alcan. It is a three step process that requires the use of complicated reactors.

In a first step, finely ground SPL material is leached in a caustic solution to remove the fluorine, free and complexed cyanide, alumina, and some silica into the leach liquor at around 85° C. In a second step, more sodium hydroxide is added at elevated pressure and temperature to destroy the cyanide in the leach solution while producing sodium fluoride. In a final step, more caustic material (generally lime) is added to the fluoride liquor to produce calcium fluoride and a recyclable, caustic leach solution. This process requires significant capital expenditure for the processing equipment and is only commercially viable on a large scale (80,000 tonnes/year). In addition, it is claimed to generate more waste by mass as a by-product than it treats.

Thermal Treatments

Several technologies for the thermal treatment of SPL have been investigated, some of which are discussed below.

Efforts have been made to use SPL as a fuel source for rockwool manufacture or by co-firing in cement kiln. Both processes can be problematic due to the impact of SPL on the final product and more importantly due to permitting and regulatory issues for co-firing a hazardous waste product. It is only deemed commercially viable when SPL material is available at large scale and not suitable as a proximal, smaller scale solution.

Alcoa have investigated the Top Submerged Lance process developed by Ausmelt for the treatment of SPL. This process is disclosed in the International patent publication no. WO94/22604. In this process, the SPL material is smelted with a submerged lance in a furnace at temperatures of 1150° C. to 1250° C. while an oxygen-containing gas is injected directly into the SPL material. The temperature is sufficiently high to destroy all cyanides and organic materials. The energy to sustain operations at these temperatures is primarily provided by the combustion of the carbon in the SPL. While efficient combustion of the SPL carbon has been demonstrated, this technology produces an off-gas stream which contains high levels of the toxic gases HF and NaF. In order to be commercially viable, the technology needs access to a fluoride plant for HF utilisation for the production of $AlF_3$ that can be recycled back to the primary process, i.e co-location with a primary aluminium plant is required.

Others have investigated the treatment of SPL in a rotary kiln such as described in patents: U.S. Pat. No. 5,711,018, U.S. Pat. No. 5,164,174 and U.S. Pat. No. 4,735,784. While good combustion of the SPL carbon was achieved, the slag shows poor leaching performance and the off-gas contains high levels of fluoride compounds. In addition, the output mass of the processed waste is significantly higher than the input mass of SPL material. Because the process does not produce a useful product or a conditioned waste which is significantly cheaper to dispose of, the economic justification for the capital and operational cost of implementing such procedures for the treatment of SPL is problematic.

Elkem Technology have investigated the treatment of SPL in an electrode arc furnace. Crushed SPL is supplied to a closed electrothermic furnace together with a $SiO_2$ source as a glass forming flux material and $Fe_2O_3$ as oxidation agent. $Fe_2O_3$ is reduced by the SPL carbon to produce $CO/CO_2$ and metallic iron which forms a separate phase from the slag. A source of CaO is used to react with all fluoride present to form $CaF_2$. This process is described in U.S. Pat. No. 5,286,274. While this process is efficient in trapping the fluorine as $CaF_2$ in the slag, the amount of oxidant agent required for the complete combustion of the SPL carbon is higher than the amount of treated SPL. Having an oxidising agent and graphite electrodes submerged in the slag melt pool will result in a high consumption of the electrodes. In addition, the process is only commercially viable if the reduced $Fe_2O_3$ can be recovered as metallic iron. Thus, the plant has to be designed accordingly which results in a significant increase in capital costs.

Columbia Ventures Corporation describes the treatment of SPL in a plasma torch furnace in International patent publication no. WO 93/21479. SPL material is fed into a plasma furnace with water or steam as an oxidant and exposed to the heat of a plasma torch. The SPL carbon is converted to CO or $CO_2$ and the fluoride is driven off as HF, which then needs to be further treated, since it cannot be released into the environment due to its harmful nature. The plasma torches described in this document are water-cooled and those exemplified are typically made from metallic components. The present inventors have found that in the harsh chemical and thermal conditions of the reactor containing high temperature airborne fluorine species the torches quickly corrode, limiting the commercial viability of the process. Further, it is described that the torch is of the transferred type, with the anode being centered coaxially within the tube and the cathode being the materials undergoing treatment or the container surface itself. In the example, the container is graphite, i.e. electrically conducting. The typical composition of SPL is such, that it is only electrically conductive in its liquid state, thus an external heat source would have to be used to provide a melt pool during start up of the process. The present inventors have found that when the container surface (or crucible surface) is electrically conductive and used as the cathode, control of the arc tends to be very difficult. It would be desirable to develop a method that does not require the preheating of the SPL material and allows more control over the arc during the process.

More stringent regulations prohibit the landfill disposal of untreated SPL and the competent authorities generally refuse to compromise the environmental standards in view of the possible legal challenges they may face. However, in some cases, derogations for landfilling are granted and will continue to be in place unless an alternative solution appears. The UK Environmental Agency (EA) and the US Environmental Protection Agency (EPA) cannot be commercially biased and they can only select technologies that are industrially available, therefore; the solution must be available, scaled and technically superior (Best Available Technique (BAT) in the UK, Best Demonstrated Available Technology (BDAT) in the US) to be a mandatory requirement. This gives rise to a position where the primary aluminium industry is in need of technological development for treatment technologies, to underpin their primary aluminium production operation. At present, the EA/EPA are not satisfied with the status of industrial solutions and they therefore insist on hazardous landfill destination requirement for all the products resulting from current SPL treatment processes.

SUMMARY OF THE INVENTION

The present invention aims to overcome or at least mitigate at least some of the problems associated with the methods of the prior art.

In a first aspect, the present invention provides: a method for treating spent pot liner material containing carbon and/or an inorganic material, the method comprising:

providing a plasma furnace having first and second electrodes for generating plasma and a crucible having a non-electrically conductive inner surface, heating the spent pot liner (SPL) material in the crucible in the presence of a flux material and an oxidant by passing an arc between the first and second electrodes via the SPL material to form a molten slag material and convert at least some of the carbon in the SPL material to CO and/or $CO_2$ and/or incorporate at least some of the inorganic material into the molten slag material.

DETAILED DESCRIPTION OF PREFERRED EMBODIMENTS

The present invention will now be further described. In the following passages different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

"Spent pot liner material" includes, but is not limited to, a material containing carbon and/or inorganic material derived from a receptacle that has used in the production of primary aluminium in an electrolysis process. The spent pot liner material is essentially an aluminium smelting by-product. "Inorganic material" includes, but is not limited to, refractory material such as silica and/or alumina. "Crucible" means a container.

The inventors have found that the process of the present invention can be used to treat SPL material and produces a non-hazardous slag while destroying most, if not all, hazardous species such as cyanides. The process is more efficient in heating the SPL material than the plasma process described above in WO 93/21479, as a graphite electrode can be used which does not require water cooling and the passage of the arc through the material is much more efficient than heating with the plasma flame. The process can be adapted, as described below, to ensure that the fluorine species are predominantly incorporated within the solid slag product, rather than being released as airborne species. The relative partitioning (i.e. separation) of fluoride species in to the off-gas and the slag is dependent on process conditions such as slag chemistry, oxidants, operating atmosphere and temperature, as described below. The present inventors have found that they can carry out the plasma treatment of SPL material with a much greater control of the arc compared to the methods disclosed in WO 93/21479.

Preferably, the spent potliner material is a particulate material. Preferably, substantially all of the particles have a diameter of 5 mm or less, more preferably 4 mm or less, most preferably 1 mm or less. "Substantially all" includes, but is not limited to, 80% or more (preferably 90% or more), by weight, of the particles have a maximum diameter as stated. It has been found that if large particles of SPL material are used, volatile reactive species such as Si(g) and Na(g) can form in local hot-spots due to encapsulation of SPL carbon in the slag, leading to carbothermic reduction. In addition to using smaller sized SPL material, ideally uniformity of temperature within the molten slag must be maintained to avoid the formation of hot-spots. This can be achieved by using a movable electrode, notably an electrode positioned above the crucible, and moving the electrode during the process, as required.

Plasma torches and electrodes are known to the skilled person in the field of plasma generation. It will be understood that a plasma torch is not considered to be a plasma electrode. Preferably, at least one of the electrodes used in the present invention comprises graphite. It has been found that a graphite electrode is able to withstand the harsh conditions of the plasma atmosphere in which airborne fluorine and other corrosive species are present to a much greater extent than metallic components typically used in plasma torches. Additionally, since carbon electrodes do not require water-cooling, there is no danger of an unwanted water leak, which would cause the process to operate outside the intended parameters.

The plasma furnace comprises a crucible in which the SPL material is treated. The plasma furnace comprises one or more first electrodes and one or more second electrodes. Preferably the first electrode(s) and/or second electrode(s) comprises graphite. The second electrode may be termed the return electrode. The one or more second electrodes may, during the method, be located below the level of the molten slag material. Preferably, a first electrode is disposed above the crucible and one or more second electrodes are disposed in or form part of the crucible such that the arc when generated passes between the electrodes through the SPL material and/or the slag material, if formed. For example, two second electrodes may be disposed in or form part of the crucible, so that in operation, the arc can pass from the first to either of the second electrodes. This configuration has been found by the present inventors to have improved uniformity of power distribution and electrical contact than, say, a configuration in which two electrodes positioned above the crucible (which does not act as an electrode) are used in a transferred arc mode, although such a configuration may be used if desired.

Preferably the or each second electrode is physically positioned in such a way that it is 1) electrically isolated from the container surface and 2) forces the arc to penetrate the material to be processed before it connects with the second electrode(s). Preferably, the second electrode(s) is/are located at or near the lowest point in the crucible.

Preferably, the oxidant comprises water and/or oxygen gas. Preferably, the oxidant flow rate is metered according to the feed rate of SPL material to allow for partial or complete gasification of the SPL carbon. Partial gasification assumes the conversion of SPL carbon to carbon monoxide, while complete gasification assumes the conversion of SPL carbon to carbon dioxide. Such flow rates can be determined by routine experimentation by the skilled person.

The present inventors have found that the amount of fluorine that can be incorporated into the molten slag material can be controlled by altering the "basicity" of the slag, which is defined as the $CaO:SiO_2$ ratio. Preferably, the flux material and/or the molten slag material contains $CaO:SiO_2$ in a molar ratio of 8:10 to 15:10. The CaO reacts with the fluorine to form $CaF_2$. Silica acts as a glass former. A glass former is defined as an oxide that readily form glasses on their own and provide the backbone of any glass network.

Preferably, the SPL is treated at a temperature of from 1200 to 1600° C.

Preferably, the SPL is introduced into the chamber into a pool of molten slag material close to the slag surface to avoid undesirable gas phase reactions. Most preferably, the SPL material is particulate, ideally having the preferable maximum particle sizes mentioned above.

Preferably, the flux material comprises one or more materials selected from silica, calcium carbonate, calcium oxide and sodium oxide.

The ratio of flux material to SPL material, by weight, is preferably 10:90 to 50:50, more preferably, 20:80 to 30:70.

Preferably, the crucible has a lining of refractory material. Generally, refractory material has been found to be resistant to fluorine-containing slags. Preferably, the refractory material includes, but is not limited to, alumina. More preferably, the lining is indirectly cooled so the slag forms a solid protective layer around the refractory. Preferably, the lining is cooled using a water-cooling system, as is known to the skilled person.

Preferably, the molten slag material is allowed to cool, optionally after removal from the plasma furnace, to form a solid, vitrified material.

An embodiment of the present invention will now be illustrated in the following non-limiting Example.

EXAMPLES

A series of tests were conducted to treat spent potlining by the method according to the present invention. SPL samples based on a mixture of first cut SPL (carbon rich) and second cut SPL (refractory rich) were used. The SPL material was crushed to a size of 2-6 mm and blended with a suitable flux material, here CaO was used. The overall chemical composition of the resulting blended feed material is shown in Table 1. Emphasis was placed on leaching performance of the produced slag, gasification of the carbon fraction and overall composition of the off-gas.

TABLE 1

| Species | Blended Feed [wt %] |
|---|---|
| $Al_2O_3$ | 11-14 |
| C | 28-33 |
| $Fe_2O_3$ | 1-2 |
| $H_2O$ | 0.1-0.3 |
| MgO | 0.1-0.3 |
| $Na_2O$ | 4-7 |
| NaF | 5-8 |
| $CaF_2$ | 3-6 |
| $AlF_3$ | 2-4 |
| $Na_3AlF_6$ | 5-8 |
| $SiO_2$ | 11-15 |
| $TiO_2$ | 0.1-0.3 |
| CaO | 17-21 |

Example 1

Reducing Atmosphere (Substoichiometric Amount of Oxygen)

A total of 46.5 kg blended SPL material was treated in a plasma furnace using a single graphite electrode (first electrode) at a feedrate of 20 kg/hr. A second electrode was positioned within the lining of the crucible, such that the it was below the level of the SPL material during operation, allowing the arc to pass from the first to second electrodes via the SPL material. The average power input was 84 kW and the average slag temperature kept at 1400-1600° C. Argon was used as the plasma gas. Oxygen and steam were used as oxidants. Thermodynamic modelling was used to determine the ratio of oxygen and steam in order to maximise the gasification rate of the SPL carbon while keeping the formation of HF low. Here, a $H_2O/O_2$ molar ratio of 1/3 was used. The overall addition of oxidants were metered to convert most SPL carbon to CO(g), thus providing a reducing atmosphere within the furnace. Ideally and according to thermodynamic modelling, a reducing atmosphere should encourage the formation of $CaF_2$ while inhibiting the formation of volatile fluorine species NaF(g). The off-gas bulk composition consisted of up to 40 vol % CO, 5 vol % $CO_2$ with the balance consisting of steam and argon. Only low levels of up to 7 ppm of HF were detected, while other volatile fluorine species such as SiF4 remained under the limit of detection.

The slag was tapped after the trial and allowed to cool under atmospheric conditions in a slag bin. The produced slag was of a glassy appearance and showed excellent leaching behaviour using the compliance leaching test BS EN 12457-3 at L/S 101/kg. This test is a two-step leaching test at L/S 2 and L/S8 (cumulative L/S10) using deionised water. The sample is crushed to <4 mm, mixed with the eluate and continuously agitated for 24 hours with no pH control. The eluates from each leaching step were separated from the sample by filtration and submitted for analysis. The result for fluorine after the first step at L/S2 was 1.94 mg/kg and after the second step at L/S10 5.3 mg/kg.

Compositional analysis of the slag as shown in Table 2 indicate high retention of fluorine in the slag, complete destruction of hazardous cyanide compounds and good gasification of the SPL carbon.

TABLE 2

| Species | Composition [wt %] |
|---|---|
| $Na_2O$ | 4.42 |
| MgO | 1.33 |
| $Al_2O_3$ | 34.78 |
| $SiO_2$ | 31.32 |
| $P_2O5$ | <0.5 |
| $SO_3$ | <0.5 |
| K2O | 0.12 |
| CaO | 23.74 |
| $TiO_2$ | 0.85 |
| MnO | — |
| $Mn_3O_4$ | 0.23 |
| $Cr_2O_3$ | <0.5 |
| $Fe_2O_3$ | 1.86 |
| NiO | <0.5 |
| BaO | <0.5 |
| PbO | <0.5 |
| C | 0.028 |
| F | 4.03 |
| Total Cyanide | <1 ppm |

Example 2

Oxidising Atmosphere (Superstoichiometric Amount of Oxygen)

A total of 65 kg blended feed material was treated during this trial at a feedrate of 20 kg/hr using the same apparatus as in Example 1. Superstoichimetric oxidising conditions were used to convert most SPL carbon to $CO_2$(g). Compared to operating under reducing conditions, this allowed for an operation at a lower average plasma power and facilitates the metering of oxidants input. The average plasma power input was 72 kW and the average slag temperature kept at 1400-1600° C.

The off-gas bulk composition consisted of up to 25 vol % $CO_2$ with the balance consisting of steam and argon. Only very low levels of less than 0.5 vol % CO was detected. HF levels were up to 100 ppm while $SiF_4$ was not detected.

The slag was tapped after the trial and allowed to cool under atmospheric condition in a slag bin. The produced slag was of a glassy appearance and showed excellent leaching behaviour using the same compliance leaching test as described in example 1. The result for fluorine after the first step at L/S2 was 5.0 mg/kg and 16 mg/kg after the second step at L/S10. Compared to the slag from example 1, the $Na_2O$ and fluorine levels are lower which indicates that operating under oxidising atmosphere increases both the formation of volatile fluoride species such as HF and NaF(g) and leachability of fluorine.

Compositional analysis of the slag as shown in Table 3 indicate complete destruction of hazardous cyanide compounds.

TABLE 3

| Species | Composition [wt %] |
|---|---|
| $Na_2O$ | 0.32 |
| MgO | 1.23 |
| $Al_2O_3$ | 45.04 |
| $SiO_2$ | 16.62 |
| $P_2O5$ | <0.5 |
| $SO_3$ | — |
| $K_2O$ | <0.5 |
| CaO | 32.8 |
| $TiO_2$ | 0.3 |
| MnO | <0.5 |
| $Mn_3O_4$ | <0.5 |
| $Cr2O_3$ | <0.5 |
| $Fe_2O_3$ | 0.39 |
| NiO | <0.5 |
| BaO | <0.5 |
| PbO | <0.5 |
| C | 2.4 |
| F | 3.38 |
| Total Cyanide | <1 ppm |

The present inventors have found that the use of small sized SPL material creates a high surface area for increased reaction kinetics. Additionally, if the speed of reaction is sufficiently high, the use of steam as an oxidant to activate the carbon is not necessary. This reduces the production of volatile fluorine species such as HF and increases the level of fluorine retained in the slag. The present inventors have found that the atmosphere within the furnace should be reducing (i.e. a substoichiometric amount of oxygen is present) to increase the formation of $CaF_2$ and to decrease the formation of volatile fluorine species such as gaseous NaF. Under reducing conditions, the formation of Na(g) is predicted which would subsequently react with CO to form a substantial amount of $Na_2CO_3$ which can either be recovered to be used as a product or recycled into the plasma furnace for treatment. Temperature uniformity within the furnace and slag melt pool should ideally be maintained to avoid undesired formation of volatile species due to local hot zones.

The invention claimed is:

1. A method for treating spent pot liner material (SPL) containing carbon and/or an inorganic material, the method comprising:

providing a plasma furnace having first and second electrodes for generating plasma and a crucible having a non-electrically conductive inner surface, heating the SPL material in the crucible in the presence of a flux material and an oxidant selected from the group consisting of steam, water, air, oxygen gas, and combinations thereof, by passing an arc between the first and second electrodes via the SPL material to form a molten slag material and convert at least some of the carbon in the SPL material to CO and/or $CO_2$ and/or incorporate at least some of the inorganic material into the molten slag material, wherein the first electrode comprises graphite and is disposed above the crucible, and wherein the second electrode is disposed in or forms part of the crucible such that the arc passes between the electrodes through the SPL material and/or the slag material.

2. The method according to claim 1, wherein the spent pot liner material comprises particulate material and 80% or more, by weight, of the particles have a diameter of 5 mm or less.

3. The method according to claim 2, wherein 80% or more, by weight, of the particles have a diameter of 4 mm or less.

4. The method according to claim 1, wherein a substoichiometric amount of oxygen is maintained within the furnace, relative to the amount of carbon in the SPL material being treated.

5. The method according to claim 1, wherein the molten slag material contains $CaO:SiO_2$ in a molar ratio of 8:10 to 15:10.

6. The method according to claim 1, wherein the molten slag material is allowed to cool, optionally after removal from the plasma furnace, to form a solid, vitrified material.

7. The method according to claim 1, wherein a pool of molten slag material has been formed in the plasma chamber from the flux material and/or SPL material and particulate SPL material is added to the pool.

8. The method according to claim 1, wherein the SPL is treated at a temperature of from 1200 to 1600° C.

9. The method according to claim 1, wherein the flux material comprises one or more materials selected from the group consisting of silica, calcium carbonate, calcium oxide, and combinations thereof.

10. The method according to claim 1, wherein the crucible has a lining of alumina.

* * * * *